United States Patent [19]

Bragg et al.

[11] Patent Number: 5,002,682

[45] Date of Patent: Mar. 26, 1991

[54] BLEACH COMPOSITIONS, THEIR MANUFACTURE AND USE IN BLEACH AND LAUNDRY COMPOSITIONS

[75] Inventors: Charles D. Bragg, Heaton; Paul A. Hardy, Gosforth, both of England

[73] Assignee: The Procter & Gamble Company, Cincinnati, Ohio

[21] Appl. No.: 603,464

[22] Filed: Apr. 24, 1984

[30] Foreign Application Priority Data

Apr. 29, 1983 [GB] United Kingdom ..... 8311865

[51] Int. Cl.[5] ..... C11D 7/18

[52] U.S. Cl. ..... 252/99; 252/89.1; 252/95; 252/102; 252/182.12; 252/182.33; 252/186.26; 252/186.27; 252/186.33

[58] Field of Search ..... 252/95, 99, 100, 103, 252/135, 186.2, 186.33, 186.38, 174.17, 174.18, 97, 186.31; 8/111

[56] References Cited

U.S. PATENT DOCUMENTS

| | | | |
|---|---|---|---|
| 3,156,654 | 11/1964 | Konecny et al. | 252/95 |
| 3,532,634 | 10/1970 | Woods | 252/95 |
| 3,583,924 | 6/1971 | Demangeon | 252/102 |
| 3,632,295 | 1/1972 | Hall et al. | 8/111 |
| 3,679,659 | 6/1972 | Zak | 536/121 |
| 4,077,768 | 3/1978 | Johnston et al. | 8/107 |
| 4,088,595 | 5/1978 | Michaelson et al. | 252/95 |
| 4,119,557 | 10/1978 | Postlethwaite | 252/99 |
| 4,240,920 | 12/1980 | deLugue | 252/99 |
| 4,297,293 | 10/1981 | Suhac et al. | 252/174.18 |
| 4,354,940 | 10/1982 | Suhac et al. | 252/181 |

FOREIGN PATENT DOCUMENTS

| | | |
|---|---|---|
| 58-189300 | 11/1983 | Japan . |
| 1268308 | 3/1972 | United Kingdom . |
| 2016540 | 3/1979 | United Kingdom . |

*Primary Examiner*—Paul Lieberman
*Assistant Examiner*—John F. McNally

[57] ABSTRACT

A bleach auxiliary for use as a peroxygen bleach catalyst comprising a water-soluble complex of iron and a multi-dentate ligand-forming chelating agent having defined bleach catalytic activity and hydrolytic and oxidative stability. The chelating agent is preferably a hydroxycarboxylic acid having the general formula I $$R[C_nH_{2n-m}(OH)_m]CO_2H \qquad \text{I}$$

wherein R is $CH_2OH$, CHO or $CO_2H$, n is from 4 to 8 and m is from 3 to n, or a salt, lactone, ether, acid ester or boric ester thereof. Bleach and laundry compositions containing the complex are also disclosed.

25 Claims, No Drawings

BLEACH COMPOSITIONS, THEIR MANUFACTURE AND USE IN BLEACH AND LAUNDRY COMPOSITIONS

TECHNICAL FIELD

The present invention relates to bleach auxiliary compositions and to use thereof in laundry bleaching and detergent compositions. In particular, it relates to laundry bleaching and detergent compositions having improved bleaching effectiveness.

BACKGROUND

The use of peroxygen bleaching agents for washing clothes and other household articles has long been known. They are particularly valuable for removing stains having a significant content of colouring matter, for instance, tea, coffee, fruit, wine and cosmetic stains. Commonly, the bleaching agent takes the form of a peroxy salt such as sodium perborate or sodium percarbonate. This is typically added to a laundry detergent composition at a level in the range from about 5% to about 35% weight.

The effectiveness of peroxygen bleaching agents is known to be very variable, however, and is greatly affected by the level of heavy metal impurities in the wash water. Indeed, in the absence of these impurities, peroxygen bleaching agents have essentially minimal bleaching activity. Large quantities of heavy metal impurities, on the other hand, promote extensive decomposition of the bleaching agent with release of gaseous oxygen. For this reason, it has been common to add a sequestering agent such as ethylenediaminetetraacetic acid (EDTA) or its salts to provide a more uniform level of free heavy metal ions in solution. The effect of these sequesterants under normal conditions, however, is not only to control bleach decomposition but also to suppress the rate and level of bleaching activity.

A number of attempts have been made in the art to boost bleach performance by deliberate addition of heavy metal materials during the manufacturing process. Thus, in GB-A-984459 a combination of a copper salt and a sequestering agent having a copper dissociation constant in the range from −11 to −15, is used together with a water-soluble perborate bleaching agent. The dissociation constant of the complex is such as to provide a level of free copper ions in solution in the range necessary for activation of the perborate. Unfortunately, however, the buffering capacity of the sequestrant in this type of system is relatively weak with the result that significant variation in the level of free copper ions can still occur. Where, on the other hand, a sequestrant of greater chelating powder is used, such as EDTA, the level of free heavy metal ions in solution is reduced to such an extent that activation of the bleaching agent is minimal; in other words, the bleaching agent is "overstabilised".

In another approach described in GB-A-1,565,807, certain preformed iron (III)/chelate complexes are described for use with hydrogen peroxide bleach liberating persalts and are said to have a pronounced activating effect on the peroxygen bleach. The materials specified are iron (III) complexes of ethylenediaminetetraacetic acid, nitrilotriacetic acid, diethylenetriaminepentaacetic acid, and hydroxyethylethylenediaminetriacetic acid. This approach also suffers drawbacks however. In particular, the iron/chelate complexes are found to produce a significant increase in the level of fabric damage as a result of localised bleach catalysis at the fabric surface. Moreover, although bleach enhancement can be observed under ideal conditions (nil water hardness, "clean" wash loads), the chelate system is unable to handle the significant variations of heavy metal content introduced in the wash load or wash solution —in other words the system lacks robustness. Other deficiencies of the chelate system include inadequate fabric whiteness end-result, essentially nil bleach enhancement in lower temperature wash cycles (less than 60° C.), and incompatibility with organic bleach activator materials commonly used for boosting low temperature wash performance.

It has now been discovered that the fundamental cause of these various performance deficiencies is one of complex instability. Thus under the pH and oxidising conditions typical of a laundry detergent or bleaching composition, the complex degrades both by hydrolysis and oxidation with formation and precipitation of ferric hydroxide. Moreover, Applicants have established that by selecting certain iron/chelate complexes having high hydrolytic and oxidative stability, it is possible to secure bleach catalytic enhancement without the adverse side effects displayed in the art.

The present invention therefore provides a bleaching auxiliary for use with a peroxygen bleaching agent or laundry detergent, the auxiliary being environmentally-acceptable and providing improved control of bleach activity over the range of wash temperatures, water hardness and soil load, with significant reduction in fabric damage and with improved fabric whiteness end-result. It also provides laundry bleaching and detergent compositions having more effective and efficient usage of peroxygen bleaching agent, thereby delivering an increased bleaching performance for any given level of peroxygen bleach, or minimising the level of peroxygen bleach required for any given level of bleaching end-result performance. The invention also provides a bleach auxiliary system for catalysing bleach activity which is fully compatible with organic peroxyacid bleach precursors.

SUMMARY OF THE INVENTION

Accordingly, the present invention provides a bleach auxiliary for use in aqueous medium as a peroxygen bleach catalyst, the bleach auxiliary comprising a water-soluble complex of iron and a multi-dentate ligand-forming chelating agent, wherein, at pH 10, the complex has a bleach catalytic activity of at least 10%, and the stability of the complex against hydrolytic and oxidative degradation to water-insoluble iron species is at least 75%.

The compositions of the invention will now be discussed in detail. All weight percentages herein are by weight of total composition, unless otherwise specified.

Suitable iron complexes are selected on the basis of defined bleach catalytic activity and defined stability against degradation to water-insoluble iron species (notably ferric hydroxide) by hydrolysis and oxidation under conditions simulating the conditions of use. In this context hydrolytic stability also includes stability against possible ferric-hydroxide producing disproportionation reactions. In addition, suitable iron complexes are water-soluble rather than colloidal in form.

The iron complex has a minimum level of catalytic activity for decomposition of the peroxygen bleaching agent of at least 10%, preferably at least 20%. In this context, catalytic activity refers to the activity of the complex in enhancing the extent of decomposition of the peroxygen bleaching agent during a heat-up cycle under controlled conditions. In detail, the catalytic activity is measured as follows:

In a Tergotometer is placed 1 litre of distilled water and 10g of a standard spray-dried detergent product containing 4.2% sodium $C_{11.8}$ linear alkyl benzene sulphonate, 8.75% Dobanol 45E7 (a condensation product of an average of 7 moles of ethylene oxide with a $C_{14}$–$C_{15}$ primary alcohol, Dobanol being a registered Trade Mark), 32.2% anhydrous pentasodium tripolyphosphate, 5% sodium silicate ($SiO_2$:$Na_2O$=1.6:1), 500ppm Mg as magnesium sulphate, 21.6% sodium perborate tetrahydrate, the remainder being sodium sulphate. The solution is then adjusted to pH 10 and heated from an initial temperature of 25° C. up to 95° C. over 30 minutes and maintained at 95° C. for a further 30 minutes. 10 ml aliquots of the solution extracted at intervals of 10 minutes throughout the heat-up cycle are then pipetted into 10 ml portions of 20% sulphuric acid solution and then diluted with 100 mls of 55° C. water. A sample thereof is then immediately titrated with 0.1N potassium permanganate solution.

The percentage of perborate decomposition (D°) is then $$D^{\circ} = 100 - \left[ \frac{\text{Titre at 60 mins}}{\text{Titre at 10 mins}} \times 100 \right]$$

The above procedure is repeated adding $8.93 \times 10^{-2}$ mmoles of the iron complex (equivalent to 5 ppm of iron).

The percentage of perborate decomposition (D) thus obtained is then used to determine the catalytic activity of the complex as follows:

$$\text{Catalytic activity} = D - D^{\circ}$$

The complex should be soluble in water to an extent of at least 1% (w/w solution) at 25° C. and preferably be substantially free of colloidal material. In this context, colloidal material refers to material which after flocculation with sodium chloride or potassium aluminium sulphate (80g/liter) is retained on a 0.1 μm millipore filter. The level of such colloidal material in the complex is preferably less than 20%, especially less than 10%, more especially less than 5%.

The stability of the complex against hydrolytic and oxidative degradation refers to the percentage of water-soluble iron complex which, in an aqueous oxidizing solution thereof at pH 10 containing 5ppm of iron and 1.85 g/liter of sodium perborate tetrahydrate, is stable against degradation to water-insoluble iron species for a period of 30 minutes under controlled heat-up conditions. In practice, the complex stability is determined as follows:

A solution of water-soluble iron complex (from which, if necessary, colloidal material has been removed by flocculation and filtration through a 0.1/μm millipore filter) is prepared in distilled water and adjusted to an iron concentration of $8.93 \times 10^{-2}$ mmoles/liter (5 ppm) and a sequestrant concentration of $8.93 \times 10^{-2} \times n \times 1.1$ mmoles/liter, where n : 1 represents the mole ratio of sequestrant to iron in the complex. The solution thus contains 10% excess sequestrant. The solution is then complemented by sodium perborate tetrahydrate (1.85 g/liter) and sodium tripolyphosphate hexahydrate (3g/liter and the pH is adjusted, if necessary, to pH 10. The solution is then heated from an initial temperature of 25° C. up to 95° C. over a period of 30 minutes. On cooling, the solution is flocculated as above and filtered through a 0.1 μm millipore filter. The complex stability is then the percentage of iron remaining in the filtrate. This should be at least 75%, preferably at least 85%, and more preferably at least 95%.

Iron complexes for use herein require both hydrolytic and oxidative stability. Nevertheless, preliminary screening can be undertaken on the basis of hydrolytic stability alone. Thus, the hydrolytic stability of the complex is preferably such that in an aqueous solution thereof at 95° C. or less and pH 10 and containing a total of 5 ppm of iron and an equivalent level of chelating agent, the level of unchelated iron is less than $10^{x}$ Molar, where and $K_{so}$ = solubility product of ferric hydroxide = $10^{-38.6}$ moles$^4$ liters$^{-4}$ at 25° C. (R. F. Platford, Canad. J. Chem., 1964, 42, 181)

It will be understood that while a pH of 10 has been taken for reference purposes the actual in-use pH of the bleach auxiliary can vary somewhat. In this context, in-use pH is taken to be the maximum pH of the aqueous medium during the bleaching process, the pH being referred to a standard 1% concentration of bleaching composition or laundry detergent composition as appropriate. Preferably, the in-use pH preferably falls in the range from about 8 to about 13, more preferably from about 8.5 to about 12.5, especially from about 9.5 to about 12.

In structural terms, the iron complex can be either a ferrous or ferric complex and preferably includes one or more aqua, hydroxy or peroxy ligands in addition to the multidentate ligand. The latter is preferably coordinated to iron exclusively through oxygen or ring nitrogen atoms, suitable ligands comprising at least two, especially at least three, coordinating groups, including at least two hydroxy, alkoxy, phenoxy or enolate coordinating groups.

A highly preferred class of materials includes the hydroxy carboxylic acid having the general formula I $$R[C_nH_{2n-m}OH)_m]CO_2H \qquad \text{I}$$

wherein R is $CH_2OH$, CHO or $CO_2H$, n is from 4 to 8, preferably 5, and m is from 3 to n, preferably 5, and also the salts, lactones, ethers, acid esters and boric esters thereof. The hydroxy acid class of materials is represented by the heptonic acids, especially D-glycero-D-guloheptonic acid, D-glycero-D-idoheptonic acid and D-glycero-D-galaheptonic acid, stereo isomers thereof and mixtures thereof (including racemic mixtures); the hexonic acids such as the gluconic acids, gulonic acids, mannonic acids, and idonic acids; the saccharic acids such as the glucaric acids and mannaric acids; the uronic acids such as the glucuronic acids, mannuronic acids and galacturonic acids; and the sugar isomers saccharinic acid and isosaccharinic acid. Salts, lactones, acid ester and boric ester derivatives are also suitable; in the case of boric esters, the parent hydroxy acid is characterized by cis hydroxyl groups on neighbouring carbon atoms of the molecule. Of all the above, preferred are the heptonic acids.

The process of making iron complexes requires careful control to ensure their preparation in water-soluble rather than colloidal form. According to a further aspect of the invention, therefore, there is provided a process of making the iron complexes herein comprising:

(a) preparing an aqueous solution containing the multidentate ligand-forming chelating agent together with a second water-soluble complex of iron and auxiliary chelating agent and optionally a water-soluble alcohol such as methanol, the first and second iron complexes being such that over a specified pH range both complexes are stable against hydrolytic degradation to water-insoluble iron species, the first iron complex having greater stability than the second iron complex within the pH range but having lower stability or being unstable at pH values below the pH range, the aqueous solution having a pH within the specified pH range and containing each chelating agent in an amount equal to or greater than that independently required for complete iron complexation, and (b) maintaining the aqueous solution within the specified pH range until chelation of iron by the multidentate ligand-forming chelating agent is complete.

In the case of ferrous complexes, the specified pH range is normally greater than pH5 and the second iron complex is stable to hydrolysis down to a pH of at least 5. In the case of ferric complexes, the specified pH range is normally greater than pH 1 and the second iron complex is stable down to a pH of at least 1. The aqueous solution will generally contain iron in excess of about 0.5% by weight, preferably in excess of about 1.5%. The more concentrated the solution, the less energy is required to produce a dry sample of complex.

A preferred process comprises preparing an aqueous solution containing a water-soluble iron salt, the multidentate ligand-forming chelating agent and the auxiliary chelating agent at a pH below the specified pH range, if necessary adjusting the pH until formation of the second iron complex is complete and then increasing the pH into the specified pH range until chelation of iron by the multidentate ligand-forming chelating agent is complete. The preferred complexes herein have optimum stability at pH values higher than the specified pH range in which case the process can include a further alkalizing step to raise the solution to the pH of optimum stability. Optionally the solution is then dried, for example, by spray drying, freeze drying, drum drying etc.

The second iron complex can be prepared from aminocarboxylate chelating agents such as ethylenediaminetetraacetic acid (EDTA), hydroxyethylethylenediaminetriacetic acid (HEEDTA), dihydroxyethylethylenediaminediacetic acid (DHEEDDA), diethylenetriaminepentaacetic acid (DETPA), nitrilotriacetic acid (NTA) 1,2-diaminocyclohexane-N,N,N',N'-tetraacetic acid (DCTA) or water-soluble salts thereof, polyphosphate chelating agents such as the tripolyphosphates and the penta and hexametaphosphates, or more preferably from aminopolyphosphonate chelating agents such as ethylenediaminetetra(methylenephosphonic acid) (EDTMP), diethylenetriaminepenta(methylenephosphonic acid) (DETPMP), nitrilotri(methylenephosphonic acid) (NTMP), hexamethylenediaminetetramethylenephosphonic acid (HMTPM) or water-soluble salts thereof.

In a preferred process for making water-soluble ferric D-glycero-D-guloheptonate, anhydrous ferric chloride (25 g) is dissolved in water (250 ml) at pH 1 and EDTA (66g) and sodium D-glycero-D-guloheptonate dihydrate (69 g) are added thereto. A concentrated solution of sodium hydroxide (50 g) is then slowly added with good agitation until the pH of the solution is 12.5 or more. The solution is then freeze-dried. In a preferred process for making water-soluble ferrous D-glycero-D-guloheptonate, ferrous sulphate heptahydrate (100 g) is dissolved in water (300 ml) at pH 4.5 and EDTMP (158 g) and sodium D-glycero-D-guloheptonate dihydrate (103 g) are added thereto. A concentrated solution of sodium hydroxide (140 g) is then slowly added with stirring until the pH of the solution is at least 10.5, preferably 12.5 or more. The solution is then freeze-dried. Optionally, the resulting solid-form ferrous complex can be converted to the corresponding ferric complex by oxidation, e.g. in a current of air or gaseous oxygen.

The stability of the iron complexes herein in the presence of other sequestrants such as the aminopolycarboxylates and aminopolyphosphonates is particularly valuable because such sequestrants, in their uncomplexed forms, have important detergency application in their own right. For example, the aminopolyphosphonates provide significant bleachable stain removal performance at low wash temperatures. Thus, the aminopolyphosphonate or aminopolycarboxylate sequestrant is preferably present at a mole ratio of sequestrant:iron complex of from about 1:1 to about 25:1, preferably from about 1:1 to about 12:1.

The present invention also provides bleaching compositions, laundry detergent and laundry additive compositions comprising the bleach auxiliary described herein together with a peroxygen bleaching agent, organic bleach activator, surfactant or detergency builder. The bleaching compositions of the invention suitably contain from about 5% to about 99.98%, preferably from about 20% to about 95% of peroxygen bleaching agent and bleach auxiliary in an amount tO provide from about 0.02% to about 5%, preferably from about 0.05% to about 1% of iron complex. The mole ratio of peroxygen bleaching agent to iron complex is from about 2000:1 to about 10:1, preferably from about 500:1 to about 100:1. The laundry compositions, on the other hand, suitably contain at least 5% of laundry matrix materials comprising from 0% to about 75% preferably from about 2% to about 40% more preferably from about 5% to about 25% of surfactant selected from anionic, nonionic, cationic, ampholytic and zwitterionic surfactants and mixtures thereof, from 0% to about 90%, preferably from about 5% to about 90%, more preferably from about 15% to about 60% of inorganic or organic detergency builder, from 0% to about 40%, preferably from about 5% to about 35%, more preferably from about 8% to about 25% of peroxygen bleaching agent, from 0% to about 40%, preferably from 0.5% to about 25%, more preferably from about 1% to about 10% of organic peroxygen bleach activator, and bleach auxiliary in an amount to provide from about 0.02% to about 5%, preferably from about 0.05% to about 1% of the iron complex. In laundry detergent and additive compositions containing peroxygen bleaching agent, the bleach and iron complex are again preferably in a mole ratio in the range from about 2000:1 to about 10:1 , more preferably from about 500:1 to about 100:1. The laundry detergent compositions preferably contain from about 0.05% to about 0.5%, more preferably from about 0.08% to about 0.3% of iron complex and about 0.05% to about 1.0%, preferably from about 0.1% to about 0.5% of amino polyphosphonate sequestrant. In laundry additive compositions designed for use with a bleach containing detergent composition, the additive composition preferably contains from about 0.1% to about 1%, more preferably from about 0.2% to about 0.8% of iron complex and from about 0.05% to about 2.5%, preferably from about 0.1% to about 1.5% of amino polyphosphonate sequestrant.

The laundry detergent compositions of the invention are preferably prepared as a dry mixture of at least three particulate components, a first component comprising detergency builder and/or surfactant, a second component comprising the iron complex, and a third component comprising particulate peroxygen bleaching agent. Dry mixing the iron complex in particulate form is valuable for improving composition storage stability. The iron complex is preferably incorporated in a water-soluble or water-dispersible organic carrier having a melting point greater than about 30° C., especially greater than about 40° C.; or it can be incorporated in a water-soluble or water dispersible agglomerated matrix of solid inorganic diluent. Alternatively, the mixture of iron complex and organic carrier can itself be agglomerated with the solid inorganic diluent. Suitable organic carriers include $C_{16}$–$C_{24}$ fatty alcohols (e.g. hydrogenated tallow alcohol) having from about 10 to about 100, preferably about 14 to about 80 ethylene oxide units, polyethyleneglycols having a molecular weight of from about 400 to about 40,000, preferably from about 1,500 to about 10,000, $C_{12}$–$C_{24}$ fatty acids and esters and amides thereof, polyvinyl pyrrolidone of molecular weight in the range from about 40,000 to about 700,000, and mixtures thereof. Suitable inorganic diluents include alkali metal, alkaline earth metal and ammonium sulphates and chlorides, neutral and acid alkali metal carbonates, orthophosphates and pyrophosphates, and alkali metal crystalline and glassy polyphosphates. A preferred inorganic diluent is sodium tripolyphosphate. Suitable water-insoluble but dispersible diluents include the finely-divided natural and synthetic silicas and silicates, especially smectite-type and kaolinite-type clays such as sodium and calcium montmorillonite, kaolinite itself, aluminosilicates, and magnesium silicates and fibrous and microcrystalline celluloses. Suitable agglomerating agents for the inorganic diluents include the organic carrier materials described above, water, aqueous solutions or dispersions of the inorganic diluent materials described above, polymer solutions and latexes such as aqueous solutions of sodium carboxymethylcellulose, methylcellulose, polyvinylacetate, polyvinylalchohol, dextrins, ethylene vinylacetate copolymers and acrylic latexes. Other suitable components of the agglomerates include polydimethylsiloxanes, paraffin oils, paraffin waxes, microcrystalline waxes, hydrophobic silica, enzymes, organic bleach activators etc. The agglomerates can be prepared by admixing the iron complex with the organic carrier or aqueous agglomerating agent which is then sprayed onto inorganic diluent in a pan agglomerator, fluidized bed, Schugi mixer etc. Desirably, the agglomerate is substantially free of unbound water (i.e. the agglomerate contains less than about 5%, especially less than about 1% thereof of moisture removeable by air-drying at 25° C.), although water in the form of water of hydration etc. can, of course, be present.

Drymixing the iron complex in agglomerated form is particularly valuable for storage stability reasons in the case of detergent compositions prepared by a spray-on of ethoxylated nonionic surfactant. Thus a preferred composition contains a dry mixture of:

(a) from about 30% to about 93.9% of spray dried base powder comprising from 0% to about 75% surfactant and from about 5% to about 90% inorganic or organic detergency builder, (b) from about 0.1% to about 20%, preferably from 0.2% to about 10% of an agglomerate comprising from about 0.02% to about 5% of iron complex incorporated in a water-soluble or water-dispersible organic carrier having a melting point greater than about 30° C. and/or in a water soluble or water-dispersible matrix of solid inorganic diluent, and (c) from about 5% to about 35% of peroxygen bleaching agent; the composition additionally containing from about 1% to about 15% of ethoxylated nonionic surfactant sprayed onto the dry mixture of spray-dried base powder, agglomerate and peroxygen bleaching agent.

Laundry additive compositions of the invention can also be prepared in granular form but preferably they are prepared in water-releasable combination with a water-insoluble dispensing carrier. Suitable additive products of this kind are described in detail in British patent application 8219318.

Especially preferred compositions herein additionally contain at least 1%, preferably from about 2% to about 20% of sodium carbonate or bicarbonate. This is found beneficial from the viewpoint of enhancing the bleach catalytic activity of the iron complexes.

The present invention also provides a process for bleaching soiled fabrics comprising the step of contacting the fabrics with an aqueous wash liquor containing:

(a) from $10^{-4}$ to $10^{-1}$, preferably from $5.10^{-3}$ to $5.10^{-2}$ mmoles/litre of a water-soluble complex or iron and a multidentate ligand-forming chelating agent, and (b) from 0.01 to 10 g/litre of peroxygen bleaching agent wherein the mole ratio of peroxygen bleaching agent to iron complex is from 2000:1 to 10:1, the complex has a bleach activity of at least 10% and the stability of the complex against hydrolytic and oxidative degradation to water-insoluble iron species is at least 75%.

Peroxygen bleaching agents suitable for use in the present compositions include hydrogen peroxide, inorganic peroxides, peroxy salts and hydrogen peroxide addition compounds, and organic peroxides and peroxy acids. Organic peroxyacid bleach precursors (bleach activators) can additionally be present.

Suitable inorganic peroxygen bleaches include sodium perborate mono-and tetrahydrate, sodium percarbonate, sodium persilicate, urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecanedioic acid, diperoxyazelaic acid, mono-and diperoxyphthalic acid and mono- and diperoxyisophthalic acid. Peroxyacid bleach precursors suitable herein are dislosed in UK-A-2040983, highly preferred being peracetic acid bleach precursors such as tetraacetylethylenediamine, tetraacetylmethylenediamine, tetracetylhexylenediamine, sodium p-acetoxybenzene sulphonate, tetraacetylglycouril, pentaacetylglucose, octaacetyllactose, and methyl O-acetoxy benzoate. The $C_6$–$C_{10}$ acyl derivatives disclosed in British Patent Application 8218867 are also highly suitable, especially the linear $C_6$–$C_{10}$ acyl oxybenzene sulphonates and carboxylates. Bleach activators can be added at a weight ratio of bleaching agent to bleach activator in the range from about 40:1 to about 4:1. Surprisingly, it is found that the bleach auxiliary of the invention is effective in combination with a conventional bleach activator to provide improved bleaching across the whole range of wash temperatures.

A wide range of surfactants can be used in the present laundry compositions. A typical listing of the classes and species of these surfactants is given in U.S. Pat. No. 3,663,961 issued to Norris on May 23, 1972 and incorporated herein by reference.

Suitable synthetic anionic surfactants are water-soluble salts of alkyl benzene sulphonates, alkyl sulphates, alkyl polyethoxy ether sulphates, paraffin sulphonates, alpha-olefin sulphonates, alpha-sulpho-carboxylates and their esters, alkyl glyceryl ether sulphonates, fatty acid monoglyceride sulphates and sulphonates, alkyl phenol polyethoxy ether sulphates, 2-acyloxy alkane-1-sulphonate, and beta-alkyloxy alkane sulphonate.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups). Examples of this group of synthetic detergents which form part of the detergent compositions of the present invention are the sodium and potassium alkyl sulphates, especially those obtained by sulphating the higher alcohols ($C_{8-18}$) carbon atoms produced by reducing the glycerides of tallow or coconut oil and sodium and potassium alkyl benzene sulphonates, in which the alkyl group contains from about 9 to about 15, especially about 11 to about 13, carbon atoms, in straight chain or branched chain configuration, e.g. those of the type described in U.S. Pat. No. 2,220,099 and U.S. Pat. No. 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

Other anionic detergent compounds herein include the sodium $C_{10-18}$ alkyl glyceryl ether sulphonates, especially those ethers of higher alcohols derived from tallow and coconut oil; sodium coconut oil fatty acid monoglyceride sulphonates and sulphates; and sodium or potassium salts of alkyl phenol ethylene oxide ether sulphate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulphonated fatty acids containing from about 6 to 20 carbon atoms in the fatty acid group and from about 1 to 10 carbon atoms in the ester group; water-soluble salts of 2-acyloxy-alkane-1-sulphonic acids containing from about 2 to 9 carbon atoms in the acyl group and from about 9 to about 23 carbon atoms in the alkane moiety; alkyl ether sulphates containing from about 10 to 18, especially about 12 to 16, carbon atoms in the alkyl group and from about 1 to 12, especially 1 to 6, more especially 1 to 4 moles of ethylene oxide; water-soluble salts of olefin sulphonates containing from about 12 to 24, preferably aout 14 to 16, carbon atoms, especially those made by reaction with sulphur trioxide followed by neutralization under conditions such that any sultones present are hydrolysed to the corresponding hydroxy alkane sulphonates; water-soluble salts of paraffin sulphonates containing from about 8 to 24, especially 14 to 18 carbon atoms, and $\beta$-alkyloxy alkane sulphonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Suitable fatty acid soaps can be selected from the ordinary alkali metal (sodium, potassium), ammonium, and alkylolammonium salts of higher fatty acids containing from about 8 to about 24, preferably from about 10 to about 22 and especially from about 16 to about 22 carbon atoms in the alkyl chain. Suitable fatty acids can be obtained from natural sources such as, for instance, from soybean oil, castor oil, tallow, whale and fish oils, grease, lard and mixtures thereof). The fatty acids also can be synthetically prepared (e.g., by the oxidation of petroleum, or by hydrogenation of carbon monoxide by the Fischer-Tropsch process). Resin acids are suitable such as rosin and those resin acids in tall oil. Napthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil.

Mixtures of anionic surfactants are particularly suitable herein, especially mixtures of sulphonate and sulphate surfactants in a weight ratio of from about 5:1 to about 1:5, preferably from about 5:1 to about 1:1, more preferably from about 5:1 to about 1.5:1. Especially preferred is a mixture of an alkyl benzene sulphonate having from 9 to 15, especially 11 to 13 carbon atoms in the alkyl radical, the cation being an alkali metal, preferably sodium; and either an alkyl sulphate having from 10 to 20, preferably 12 to 18 carbon atoms in the alkyl radical or an ethoxy sulphate having from 10 to 20, preferably 10 to 16 carbon atoms in the alkyl radical and an average degree of ethoxylation of 1 to 6, having an alkali metal cation, preferably sodium.

The nonionic surfactants useful in the present invention are condensates of ethylene oxide with a hydrophobic moiety to provide a surfactant having an average hydrophilic-lipophilic balance (HLB) in the range from about 8 to 17, preferably from about 9.5 to 13.5, more preferably from about 10 to about 12.5. The hydrophobic moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 3 to 30, preferably 5 to 14 moles of ethylene oxide per mole of alkyl phenol. The alkyl substituent in such compounds may be derived, for example, from polymerised propylene, di-isobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 13 moles of ethylene oxide.
2. The condensation product of primary or secondary aliphatic alcohols having from 8 to 24 carbon atoms, in either straight chain or branched chain configuration, with from 2 to about 40 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade Name of BASF, Dobanol and Neodol being Trade Names of Shell), or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Cationic surfactants suitable for use herein include quaternary ammonium surfactants and surfactants of a semi-polar nature, for example amine oxides. Suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are again substituted by methyl, hydroxyethyl or hydroxypropyl.

The laundry compositions of the invention can also contain up to about 90% of detergency builder, preferably from about 15% to about 60% thereof.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, pyrophosphates, tripolyphosphates and bicarbonates.

Examples of suitable organic alkaline detergency builder salts are water-soluble polycarboxylates such as the salts of nitrilotriacetic acid, lactic acid, glycollic acid and ether derivatives thereof as disclosed in BE-A-821,368, 821,369 and 821,370; succinic acid, malonic acid, (ethylenedioxy)diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propanetetracarboxylic acid and 1,1,2,3-propane tetracarboxylic acid; cyclopentane cis, cis,cis-tetracarboxylic acid, cyclopentadienide pentacarboxylic acid, 2,3,4,5-tetra hyorofuran-cis, cis, cis-tetracarboxylic acid, 2,5-tetra-hydro-furan-cis-di-carboxylic acid, 1,2,3,4,5,6-hexane-hexacarboxylic acid, mellitic acid, pyromellitic acid and the phthalic acid derivatives disclosed in GB-A-1,425,343.

Mixtures of organic and/or inorganic builders can be used herein. One such mixture of builders is disclosed in CA-A-755,038, e.g. a ternary mixture of sodium tripolyphosphate, trisodium nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of GB-A-1,429,143 published Mar. 24, 1976, DE-A-2,433,485 published Feb. 6, 1975 and DE-A-2,525,778 published Jan. 2, 1976, the disclosures of which are incorporated herein by reference.

An alkali metal, or alkaline earth metal, silicate can also be present. The alkali metal silicate is preferably from about 3% to about 15%. Suitable silicate solids have a molar ratio of $SiO_2$/alkali metal$_2$O in the range from about 1.0 to about 3.3, more preferably from 1.5 to 2.0.

The compositions of the invention can be supplemented by all manner of detergent and laundering components, inclusive of suds suppressors, enzymes, fluorescers, photoactivators, soil suspending agents, anticaking agents, pigments, perfumes, fabric conditioning agents etc.

Suds suppressors are represented by materials of the silicone, wax, vegetable and hydrocarbon oil and phosphate ester varieties. Suitable silicone suds controlling agents include polydimethylsiloxanes having a molecular weignt in the range from about 200 to about 200,000 and a kinematic viscosity in the range from about 20 to about 2,000,000 $mm^2/s$, preferably from about 3000 to about 30,000 $mm^2/s$, and mixtures of siloxanes and hydrophobic silanated (preferably trimethylsilanated) silica having a particle size in the range from about 10 millimicrons to about 20 millimicrons and a specific surface area above about 50 $m^2/g$. Suitable waxes include microcrystalline waxes having a melting point in the range from about 65° C. to about 100° C., a molecular weight in the range from about 4000–1000, and penetration value of at least 6, measured at 77° C. by ASTM-D1321, and also paraffin waxes, synthetic waxes and natural waxes. Suitable phosphate esters include mono and/or di-$C_{16}$–$C_{22}$ alkyl or alkenyl phosphate esters, and the corresponding mono- and/or di alkyl or alkenyl ether phosphates containing up to 6 ethoxy groups per molecule.

Enzymes suitable for use herein include those discussed in U.S. Pat. No. 3,519,570 and U.S. Pat. No. 3,533,139 to McCarty and McCarty et al issued July 7, 1970 and Jan. 5, 1971, respectively. Suitable fluorescers include Blankophor MBBH (Bayer AG) and Tinopal CBS and EMS (Ciba Geigy). Photoactivators are discussed in EP-A-57088, highly preferred materials being zinc phthalocyanine, tri- and tetra-sulfonates. Suitable fabric conditioning agents include smectite-type clays as disclosed in GB-A-1400898 and di-$C_{12}$–$C_{24}$ alkyl or alkenyl amines and ammonium salts.

Anitredeposition and soil suspension agents suitable herein include cellulose derivatives such as methylcellulose, carboxymethylcellulose and hydroxyethylcellulose, and homo- or co-polymeric polycarboxylic acids or their salts in which the polycarboxylic acid comprises at least two carboxyl radicals separated from each other by not more than two carbon atoms. Polymers of this type are disclosed in GB-A-1,596,756 incorporated herein by reference. Preferred polymers include copolymers or salts thereof of maleic anhydride with ethylene, methylvinyl ether, acrylic acid or methacrylic acid, the maleic anhydride constituting at least about 20 mole percent of the copolymer. These polymers are valuable for improving whiteness maintenance, farbic ash deposition, and cleaning performance on clay, proteinaceous and oxidizable soils in the presence of transition metal impurities.

In the Examples which follow, the abbreviations used having the following designation:

| | |
|---|---|
| LAS | Linear $C_{11.8}$ alkyl benzene sulphonate. |
| AS | Sodium linear $C_{12-14}$ alcohol sulphate. |
| TAS | Tallow alcohol sulphate. |
| MAO | $C_{12}$–$C_{14}$ alkyl dimethylamine oxide. |
| CATAB | Coconut alkyl trimethylammonium bromide |
| Dobanol 45-E-n | A $C_{14-15}$ oxo-alcohol with n moles of ethylene oxide, marketed by Shell. |
| TAED | Tetraacetyl ethylene diamine. |
| Silicate | Sodium silicate having an $SiO_2$:$Na_2O$ ratio of 1.6:1. |

-continued

| | |
|---|---|
| Wax | Microcrystalline wax - Witcodur 272 M.pt. 87° C. |
| Silicone Prill | Comprising 0.14 parts by weight of an 85.15 by weight mixture of silanated silica and silicone granulated with 1.3 parts of sodium tripolyphosphate, and 0.56 parts of tallow alcohol condensed with 25 molar proportions of ethylene oxide. |
| Porphine | Tri/tetra sulphonated zinc phthalocyanine. |
| Gantrez AN 119 | Trade name for maleic anhydride/vinyl methyl ether co-polymer, believed to have an average molecular weight of about 240,000, marketed by GAF. This was prehydrolysed with NaOH before addition. |
| MA/AA | Copolymer of 1:4 maleic/acrylic acid, average molecular weight about 80,000. |
| Brightener | Disodium 4,4'-bis(2-morpholino-4-anilino-s-triazino-6-ylamino)stilbene-2:2' -disulphonate. |
| Dequest 2060 | Trade Name for diethylenetriaminepenta(methylene-phosphonic acid), marketed by Monsanto. |
| Dequest 2041 | Trade Name for ethylendiamine tetra(methylene phosphonic acid) monohydrate, marketed by Monsanto. |

The present invention is illustrated by the following non-limiting examples:

EXAMPLES 1 TO 6

The following granular laundry compositions are prepared by admixing all ingredients apart from the nonionic surfactant, bleach, silicone prill, enzyme and agglomerate, in a crutcher as an aqueous slurry at a temperature in the range from 70° C. to 90° C., adjusting the crutcher content of the slurry to within the range from 30% to 38% by weight, spray drying the slurry at a drying gas inlet temperature in the range from 275° C. to 330° C., admixing the bleach, silicone prill, enzyme and agglomerate, the spraying the nonionic surfactant onto the resulting granular mixture. All figures are given as % by weight.

| | 1 | 2 | 3 | 4 | 5 | 6 |
|---|---|---|---|---|---|---|
| LAS | 4 | 8 | 8 | — | 7 | 5 |
| AS | 4 | — | — | 9 | — | 3 |
| TAS | — | — | 4 | 3 | — | — |
| MAO | — | — | 1.8 | 2 | — | — |
| CATAB | — | 2 | 1 | — | 2 | — |
| Dobanol 45-E-7 | 4 | 6 | 5 | 6 | 5 | 10 |
| Dobanol 45-E-4 | — | — | — | — | 2 | — |
| TAED | 1 | — | 6 | — | — | — |
| Silicate | 5 | 6 | 3 | 7 | 4 | 10 |
| Wax | — | — | — | — | — | 2 |
| Silicone Prill | — | — | 2 | 3 | — | 0.5 |
| Gantrez AN119 | — | — | 0.8 | 1.5 | — | 1 |
| MA/AA | 2 | 1 | — | — | 1.2 | — |
| Brightener | 0.3 | 0.2 | 0.4 | 0.3 | 0.2 | 0.2 |
| Dequest 2060 | 0.3 | — | — | — | — | 0.2 |
| Dequest 2041 | — | — | 0.4 | — | — | — |
| Sodium Perborate Tetrahydrate | 12 | 15 | 16 | — | 10 | 15 |
| Sodium Percarbonate | — | — | 18 | — | — | |
| Alcalase Enzyme | 0.6 | 1 | — | — | — | 0.8 |
| Sodium Tripolyphosphate | 30 | 28 | 25 | 32 | 28 | 30 |
| Sodium Carbonate | 10 | — | 2 | — | 5 | — |
| Magnesium Sulphate | — | 0.5 | — | — | — | 0.5 |
| Agglomerate I | 5 | — | — | — | — | — |

-continued

| | 1 | 2 | 3 | 4 | 5 | 6 |
|---|---|---|---|---|---|---|
| Agglomerate II | — | 2.2 | — | — | — | — |
| Agglomerate III | — | — | 1.5 | — | — | — |
| Agglomerate IV | — | — | — | 3 | — | — |
| Agglomerate V | — | — | — | — | 2.5 | — |
| Agglomerate VI | — | — | — | — | — | 3 |
| Sodium Sulphate, Moisture and Miscellaneous | | | To 100 | | | |

In the above, Agglomerates I to VI have the following compositions. Agglomerates I, II and V are prepared by spraying the organic components onto a fluidized bed of sodium tripolyphosphate; Agglomerates III and VI are prepared by extrusion; and Agglomerate IV is prepared using a drum agglomerator.

| | Agglomerate | | | | | |
|---|---|---|---|---|---|---|
| | I | II | III | IV | V | VI |
| Ferrous D-glycero-D-guloheptonate | — | 5.5 | — | 2.8 | — | 5 |
| Ferric D-glycero-D-guloheptonate | 2.5 | — | 5 | — | 5.5 | — |
| EDTA | — | — | — | — | 6 | — |
| Dequest 2041 | — | 9 | — | — | — | — |
| Dequest 2060 | 5.5 | — | — | — | — | 11 |
| TAE25 | 12 — | 15 | — | 3 | 6 | 14 |
| PEG 4000 | — | — | 1 | — | 6 | — |
| $TAED_{25}$ | — | — | — | — | — | 70 |
| $C_{12}$ Fatty Acid Amide | — | — | 5 | — | — | — |
| Polyvinylpyrrolidone | — | — | 1 | — | | |
| Dextrin | — | — | 4 | — | — | — |
| Alcalase Enzyme | — | — | 12 | — | — | — |
| Silicone | — | 10 | — | — | 10 | — |
| Silanated Silica | 1 | 0.5 | — | — | 0.5 | — |
| Wax | — | — | — | — | 6 | — |
| Paraffin Wax m.p. 50° C. | 2 | — | — | — | — | — |
| Paraffin Oil | 4 | — | — | — | — | — |
| Porphine | — | — | — | 0.2 | — | — |
| Sodium Tripoly-phosphate(anhydrous) | 58 | 47 | — | 74 | 47 | — |
| Sodium Sulphate | — | — | 12 | — | — | — |
| Sodium Chloride | — | — | 50 | — | — | — |
| $TiO_2$ | — | — | 10 | — | — | — |
| Water | 15 | 13 | — | 20 | 13 | |

The above compositions combine excellent storage-stability, fabric care and all-temperature detergency performance on bleachable-type stains. Improved performance is also obtained when ferrous and ferric D-glycero-D-guloheptonate are replaced by equimolar proportions of the ferrous and ferric salts of D-glycero-D-idoheptonic acid, D-glycero-D-galaheptonic acid and the stereoisomers of the above acids, and mixtures thereof.

What is claimed is:

1. A bleach auxiliary for use in aqueous medium as a peroxygen bleach catalyst, the bleach auxiliary comprising a water-soluble complex of iron and a multi-dentate ligand-forming chelating agent, wherein, at pH 10, the complex has a bleach catalytic activity as determined in the catalytic activity test described herein of at least 10% and the stability of the complex against hydrolytic and oxidative degradation to water-insoluble iron species as determined in the complex stability test described herein is at least 75%, said complex being incorporated in a water-soluble or water-dispersible organic carrier having a melting point greater than about 30° C. and/or in a water-soluble or water-dispersible agglomerated matrix of solid inorganic diluent, said bleach auxiliary containing by weight from 0 to 20% water.

2. An auxiliary according to claim 1 wherein the stability of the complex is such that in an aqueous solution thereof at 95° C. or less and pH 10 and containing a total of 5 ppm of iron and an equivalent level of chelating agent, the level of unchelated iron is less than $10^{-x}$ Molar, where $$x = \log_{10} K_{so} + 12,$$

and $K_{so}$ = solubility product of ferric hydroxide.

3. An auxiliary according to claim 1 wherein the complex additionally comprises one or more ligands selected from the group consisting of aquo, hydroxy and peroxy ligands.

4. An auxiliary according to claim 3 wherein the multidentate ligand is coordinated to iron exclusively through oxygen or ring nitrogen atoms.

5. An auxiliary according to claim 4 wherein the multidentate ligand comprises at least three coordinating groups including at least two selected from the group consisting of hydroxy, alkoxy, phenoxy and enolate coordinating groups.

6. An auxiliary according to claim 1 wherein the chelating agent is selected from the group consisting of hydroxy carboxylic acids having the general formula I $$R]C_nH_{2n-m}(OH)_m]CO_2H \qquad \text{I}$$

wherein R is $CH_2OH$, CHO or $CO_2H$, n is from 4 to 8 and m is from 3 to n, and the salts, lactones, ethers, acid esters and boric esters thereof.

7. An auxiliary according to claim 6 wherein the chelating agent is selected from the group consisting of D-glycero-D-gulo heptonic acid, D-glycero-D-idoheptonic acid, stereoisomers thereof, mixtures thereof, and salts, lactones, acid esters and boric esters thereof.

8. An auxiliary according to claim 6 additionally comprising an aminopolyphosphonate selected from the group consisting of nitrilotri(methylenephosphonic acid), ethylenediamine tetra(methylenephosphonic acid), diethylenetriaminepenta (methylenephosphonic acid), hexamethylenediaminetetra(methylenephosphonic acid) and water-soluble salts thereof, an aminopolycarboxylate selected from the group consisting of nitrilotriacetic acid, ethylenediaminetetraacetic acid, hydroxyethylethylenediaminetriacetic acid, dihydroxyethylethylenediaminediacetic acid, 1,2-diaminocyclohexane-N,N,N',N'-tetraacetic acid, diethylenetriaminepentaacetic acid and water-soluble salts thereof, or a polyphosphate selected from the group consisting of tripolyphosphates and the penta- and hexametaphosphates, wherein the mole ratio of aminopolyphosphonate and/or aminopolycarboxylate and/or polyphosphate to iron complex is from about 1:1 to about 25:1.

9. A bleach auxiliary suitable for use in aqueous medium as a peroxygen bleach catalyst comprising an iron complex consisting essentially of a water-soluble, substantially non-colloidal complex of iron and a multidentate ligand forming chelating agent, the chelating agent being selected from the group consisting of hydroxycarboxylic acids having the general formula I $$R[C_nH_{2n-m}(OH)_m]CO_2H \quad I$$

wherein R is $CH_2OH$, CHO or $CO_2H$, n is from 4 to 8, m is from 3 to n, and the salts, lactones, ethers, acid esters and boric esters thereof, said complex being incorporated in a water-soluble or water-dispersible organic carrier having a melting point greater than about 30° C. and/or in a water-soluble or water-dispersible agglomerated matrix of solid inorganic diluent, said bleach auxiliary containing by weight from 0 to 20% water.

10. An auxiliary according to claim 1 or 9 in particulate form.

11. A bleach composition in granular form or in water-releasable combination with a water-insoluble dispensing carrier, said composition comprising a mixture of bleach auxiliary and peroxygen bleaching agent wherein the bleach auxiliary comprises a water-soluble complex of iron and a multi-dentate ligand-forming chelating agent, wherein, at pH 10, the complex has a bleach catalytic activity as determined in the catalytic activity test described herein of at least 10% and the stability of the complex against hydrolytic and oxidative degradation to water-soluble iron species as determined in the complex stability test described herein is at least 75% and wherein the mole ratio of peroxygen bleaching agent to iron complex is in the range from about 2000:1 to about 10:1, said bleach auxiliary containing by weight from 0 to 20% water.

12. A bleach composition in granular form or in water-releasable combination with a water-insoluble dispensing carrier, said composition comprising a mixture of bleach auxiliary and peroxygen bleaching agent wherein the bleach auxiliary comprises an iron complex consisting essentially of a water-soluble, substantially non-colloidal complex of iron and a multi-dentate ligand forming chelating agent, the chelating agent being selected from the group consisting of hydroxycarboxylic acids having the general formula I $$R[C_nH_{2n-m}(OH)_m]CO_2H \quad I$$

wherein R is $CH_2OH$, CHO or $CO_2H$, n is from 4 to 8, m is from 3 to n, and the salts, lactones, ethers, acid esters and boric esters thereof and wherein the mole ratio of peroxygen bleaching agent to iron complex is the range from about 2000:1 to about 10:1, said bleach auxiliary containing by weight from 0 to 20% water.

13. A bleach composition according to claim 12 additionally comprising an aminopolyphosphonate selected from the group consisting of nitrilotri(methylenephosphonic acid), ethylenediamine tetra(methylenephosphonic acid), diethylenetriaminepenta (methylenephosphonic acid), hexamethylenediaminetetra(methylenephosphonic acid) and water-soluble salts thereof, an aminopolycarboxylate selected from the group consisting of nitrilotriacetic acid, ethylenediaminetetraacetic acid, hydroxyethylethylenediaminetriacetic acid, dihydroxyethylethylenediaminediacetic acid, 1,2-diaminocyclohexane-N,N,N',N'-tetraacetic acid, diethylenetriaminepentaacetic acid and water-soluble salts thereof, or a polyphosphate selected from the group consisting of tripolyphosphates and the penta- and hexametaphosphates, wherein the mole ratio of aminopolyphosphonate and/or aminopolycarboxylate and/or polyphosphate to iron complex is from about 1:1 to about 25:1.

14. A bleach composition according to claim 12 wherein the iron complex is incorporated in a water-soluble or water-dispersible organic carrier having a melting point greater than about 30° C. and/or in a water-soluble or water-dispersible agglomerated matrix of solid inorganic diluent.

15. A laundry composition in granular form or in water-releasable combination with a water-insoluble dispensing carrier, said composition comprising:

(a) at least about 5% by weight of laundry matrix materials comprising one or more of
  (i) up to about 75% by weight of organic surfactant selected from the group consisting of anionic, nonionic, cationic, amphoteric and zwitterionic surfactants and mixtures thereof,
  (ii) up to about 90% of inorganic or organic detergency builder, and
  (iii) up to about 40% each of peroxygen bleaching agent and/or organic activator therefor, and
(b) a bleach auxiliary comprising a water-soluble complex of iron and a multi-dentate ligand-forming chelating agent, wherein, at pH 10, the complex has a bleach catalytic activity as determined in the catalytic activity test described herein of at least 10% and the stability of the complex against hydroytic and oxidative degradation to water-insoluble iron species as determined in the complex stability test described herein is at least 75%, wherein the bleach auxiliary is in an amount sufficient to provide from 0.02% to 5% of iron complex, said bleach auxiliary containing by weight from 0 to 20% water.

16. A laundry composition in granular form or in water-releasable combination with a water-insoluble dispensing carrier, said composition comprising:

(a) at least about 5% by weight of laundry matrix material comprising one or more of
  (i) up to about 75% by weight of organic surfactant selected from the group consisting of anionic, nonionic, cationic, amphoteric and zwitterionic surfactants and mixtures thereof,
  (ii) up to about 90% of inorganic or organic detergency builder, and
  (iii) up to about 40% each of peroxygen bleaching agent and/or organic activator therefor, and
(b) a bleach auxiliary comprising an iron complex consisting essentially of a water soluble, substantially non-colloidal complex of iron and a multi-dentate ligand forming chelating agent, the chelating agent being selected from the group consisting of hydroxycarboxylic acids having the general formula I $$R[C_nH_{2n-m}(OH)_m]CO_2H \quad I$$

wherein R is $CH_2OH$, CHO, or $CO_2H$, n is from 4 to 8, m is from 3 to n, and the salts, lactones, ethers, acid esters and boric esters thereof, wherein the bleach auxiliary is in an amount sufficient to provide from 0.02% to 5% of iron complex, said bleach auxiliary containing by weight from 0 to 20% water.

17. A composition according to claim 16 additionally comprising an aminopolyphosphonate selected from the group consisting of nitrilotri(methylenephosphonic acid), ethylenediamine tetra(methylenephosphonic acid), diethylenetriaminepenta (methylenephosphonic acid), hexamethylenediaminetetra(methylenephosphonic acid) and water-soluble salts thereof, an aminopolycarboxylate selected from the group consisting of nitrilotriacetic acid, ethylenediaminetetraacetic acid, hydroxyethylethylenediaminetriacetic acid, dihydroxyethylethylenediaminediacetic acid, 1,2-diaminocyclohexane-N,N,N',N'-tetraacetic acid, diethylenetriaminepentaacetic acid and water-soluble salts thereof, or a polyphosphate selected from the group consisting of tripolyphosphates and the penta- and hexametaphosphates, wherein the mole ratio of aminopolyphosphonate and/or aminopolycarboxylate and/or polyphosphate to iron complex is from about 1:1 to about 25:1.

18. A composition according to claim 16 wherein the iron complex is incorporated in a water-soluble or water-dispersible organic carrier having a melting point greater than about 30° C. and/or in a water-soluble or water-dispersible agglomerated matrix of solid inorganic diluent.

19. A composition according to claim 16 comprising a dry mixture of (a) from about 30% to about 93.9% of spray dried base powder comprising from 0% to about 75% of surfactant and from about 5% to about 90% of detergency builder, (b) from about 0.1% to about 20% of an agglomerate comprising from about 0.02% to about 5% of iron complex, and (c) from about 5% to about 35% of particulate peroxygen bleaching agent; the composition additionally comprising from about 1% to about 15% of ethoxylated nonionic surfactant sprayed onto the dry mixture of base powder, agglomerate and peroxygen bleaching agent.

20. A composition according to claim 16 in water-releasable combination with a water-insoluble dispensing carrier.

21. A composition according to claim 16 additionally comprising from about 2% to about 20% sodium carbonate of bicarbonate.

22. The bleach auxiliary of claim 1 wherein said solid inorganic diluent is selected from the group consisting of alkali metal, alkaline earth metal and ammonium sulfates and chlorides, neutral and acid alkali metal carbonates, orthophosphates and pyrophosphates, alkali metal crystalline and glassy polyphosphates, aluminosilicates, and fibrous and microcrystalline celluloses.

23. The bleach auxiliary of claim 9 wherein said solid inorganic diluent is selected from the group consisting of alkali metal, alkaline earth metal and ammonium sulfates and chlorides, neutral and acid alkali metal carbonates, orthophosphates and pyrophosphates, alkali metal crystalline and glassy polyphosphates, aluminosilicates and fibrous and microcrystalline celluloses.

24. The bleach auxiliary of claim 14 wherein said solid inorganic diluent is selected from the group consisting of alkali metal, alkaline earth metal and ammonium sulfates and chlorides, neutral and acid alkali metal carbonates, orthophosphates and pyrophosphates, alkali metal crystalline and glassy polyphosphates, aluminosilicates and fibrous and microcrystalline celluloses.

25. The bleach auxiliary of claim 18 wherein said solid inorganic diluent is selected from the group consisting of alkali metal, alkaline earth metal and ammonium sulfates and chlorides, neutral and acid alkali metal carbonates, orthophosphates and pyrophosphates, alkali metal crystalline and glassy polyphosphates, aluminosilicates and fibrous and microcrystalline celluloses.

* * * * *